US011170693B2

(12) United States Patent
Park et al.

(10) Patent No.: US 11,170,693 B2
(45) Date of Patent: Nov. 9, 2021

(54) DISPLAY DEVICE PERFORMING STILL IMAGE DETECTION, AND METHOD OF OPERATING THE DISPLAY DEVICE

(71) Applicant: Samsung Display Co., Ltd., Yongin-si (KR)

(72) Inventors: Sehyuk Park, Seongnam-si (KR); Hyojin Lee, Yongin-si (KR); Jinyoung Roh, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/788,647

(22) Filed: Feb. 12, 2020

(65) Prior Publication Data

US 2020/0327846 A1 Oct. 15, 2020

(30) Foreign Application Priority Data

Apr. 9, 2019 (KR) ..... 10-2019-0041325

(51) Int. Cl.
*G09G 3/20* (2006.01)

(52) U.S. Cl.
CPC ..... *G09G 3/2044* (2013.01); *G09G 2320/029* (2013.01); *G09G 2320/103* (2013.01); *G09G 2340/16* (2013.01)

(58) Field of Classification Search
CPC ..... G09G 2320/029; G09G 2320/103; G09G 2340/16; G09G 3/2044
See application file for complete search history.

(56) References Cited

U.S. PATENT DOCUMENTS

| | | | | |
|---|---|---|---|---|
| 8,427,513 | B2 | 4/2013 | Shidara et al. | |
| 8,982,108 | B2 | 3/2015 | Lee et al. | |
| 9,892,709 | B2 | 2/2018 | Choi et al. | |
| 2014/0022220 | A1 | 1/2014 | Lee et al. | |
| 2014/0111564 | A1* | 4/2014 | Jeon | G09G 3/3648 345/691 |
| 2015/0206467 | A1 | 7/2015 | Choi et al. | |

FOREIGN PATENT DOCUMENTS

| | | |
|---|---|---|
| KR | 10-2015-0086826 | 7/2015 |
| KR | 10-1954947 | 3/2019 |

* cited by examiner

*Primary Examiner* — Afroza Chowdhury
(74) *Attorney, Agent, or Firm* — H.C. Park & Associates, PLC

(57) ABSTRACT

A display device including a display panel including a plurality of pixels, and a driver configured to drive the display panel. The driver includes a dither configured to perform a dithering operation on image data including a plurality of pixel data for the plurality of pixels to generate dithered image data including a plurality of dithered pixel data respectively corresponding to the plurality of pixel data, and a still image detector configured to receive the dithered image data, to detect dither-irrelevant pixel data that are not changed from the plurality of pixel data by the dithering operation among the plurality of dithered pixel data, and to determine whether the dithered image data represent a still image by using the dither-irrelevant pixel data.

16 Claims, 10 Drawing Sheets

DISPLAY DEVICE PERFORMING STILL IMAGE DETECTION, AND METHOD OF OPERATING THE DISPLAY DEVICE

CROSS REFERENCE TO RELATED APPLICATION

This application claims priority from and the benefit of Korean Patent Application No. 10-2019-0041325, filed on Apr. 9, 2019, which is hereby incorporated by reference for all purposes as if fully set forth herein.

BACKGROUND

Field

Exemplary embodiments of the invention relate generally to a display device, and more specifically to a display device performing still image detection and a method of operating the display device.

Discussion of the Background

Reduction of power consumption is desirable in a display device employed in a portable device, such as a smartphone, a tablet computer, etc. Recently, in order to reduce the power consumption of the display device, a technique has been developed for differentiating a driving method for a still image that is not changed in consecutive frames from a driving method for a moving image that is changed per frame. Further, in order to differentiate the driving method for the still image from the driving method for the moving image, a technique for detecting the still image is required.

A conventional still image detection technique detects the still image by comparing image data in consecutive frames. However, in a case where a dithering technique is applied to increase grayscale resolution of an image, dithered image data for the still image may be changed per frame in each dithering cycle. Accordingly, in order to detect the still image in a display device to which the dithering technique is applied, a time period corresponding to at least two dithering cycles is required.

The above information disclosed in this Background section is only for understanding of the background of the inventive concepts, and, therefore, it may contain information that does not constitute prior art.

SUMMARY

Exemplary embodiments of the present invention provide a display device capable of rapidly detecting a still image even if a dithering technique is applied.

Exemplary embodiments of the present invention also provide a method of operating a display device capable of rapidly detecting a still image even if a dithering technique is applied.

Additional features of the inventive concepts will be set forth in the description which follows, and in part will be apparent from the description, or may be learned by practice of the inventive concepts.

An exemplary embodiment of the present invention provides a display device including a display panel including a plurality of pixels, and a driver configured to drive the display panel. The driver includes a dither configured to perform a dithering operation on image data, including a plurality of pixel data for the plurality of pixels, to generate dithered image data including a plurality of dithered pixel data respectively corresponding to the plurality of pixel data, and a still image detector configured to receive the dithered image data, to detect dither-irrelevant pixel data that are not changed from the plurality of pixel data by the dithering operation among the plurality of dithered pixel data, and to determine whether the dithered image data represent a still image by using the dither-irrelevant pixel data.

The still image detector may be configured to determine whether the dithered image data represent the still image by comparing the dither-irrelevant pixel data in a first frame and the dither-irrelevant pixel data in a second frame directly after the first frame.

The still image detector may include a comparison pixel ratio determiner configured to detect the dither-irrelevant pixel data among the plurality of dithered pixel data, to calculate, as a comparison pixel ratio, a ratio of a number of the dither-irrelevant pixel data to a number of the plurality of dithered pixel data, and to compare the comparison pixel ratio with a reference pixel ratio.

The still image detector may further include a data comparator configured to determine whether the dithered image data represent the still image by comparing the dither-irrelevant pixel data in a first frame and the dither-irrelevant pixel data in a second frame directly after the first frame when the comparison pixel ratio is greater than or equal to the reference pixel ratio.

When the comparison pixel ratio is less than the reference pixel ratio, the comparison pixel ratio determiner may detect, among dither-relevant pixel data other than the dither-irrelevant pixel data in the plurality of dithered pixel data, the dither-relevant pixel data that are not changed in a first frame and a second frame directly after the first frame based on a dithering pattern of the dithering operation, to recalculate, as the comparison pixel ratio, a ratio of a sum of the number of the dither-irrelevant pixel data and a number of the dither-relevant pixel data that are not changed in the first frame and the second frame to the number of the plurality of dithered pixel data, and to compare the recalculated comparison pixel ratio with the reference pixel ratio.

The still image detector may further include a data comparator configured to determine whether the dithered image data represent the still image by using the dither-irrelevant pixel data and the dither-relevant pixel data that are not changed in the first frame and the second frame when the recalculated comparison pixel ratio is greater than or equal to the reference pixel ratio.

When the recalculated comparison pixel ratio is less than the reference pixel ratio, the comparison pixel ratio determiner further detects the dither-relevant pixel data that are not changed in the first frame and at least one frame subsequent to the second frame based on the dithering pattern until the comparison pixel ratio to which a number of the further detected dither-relevant pixel data is applied becomes greater than or equal to the reference pixel ratio. The still image detector may further include a data comparator configured to determine whether the dithered image data represent the still image by using the dither-irrelevant pixel data, the dither-relevant pixel data that are not changed in the first frame and the second frame, and the dither-relevant pixel data that are not changed in the first frame and the at least one frame subsequent to the second frame.

The comparison pixel ratio determiner may add dither-relevant pixel data that are not changed in a first frame and at least one subsequent frame to comparison pixel data that are used to determine whether the dithered image data represent the still image until the comparison pixel ratio becomes greater than or equal to the reference pixel ratio.

The still image detector may further include a data comparator configured to determine whether the dithered image data represent the still image by using the dither-irrelevant pixel data and the dither-relevant pixel data that are not changed in the first frame and the at least one subsequent frame. The subsequent frame may be sequentially selected from a second frame through (2^M+1)-th frame, where M is a bit number corresponding to a dithering cycle of the dither.

The still image detector may further include a data storage configured to store a representative value of the dither-irrelevant pixel data in a first frame, and a data comparator configured to determine whether the dithered image data represent the still image by comparing the representative value stored in the data storage and a representative value of the dither-irrelevant pixel data in a second frame directly after the first frame.

The driver may perform low frequency driving that drives the display panel with a low frame rate less than a normal frame rate when the dithered image data represent the still image.

Another exemplary embodiment provides a method of operating a display device including a plurality of pixels. In the method, image data including a plurality of pixel data for the plurality of pixels may be received, dithered image data including a plurality of dithered pixel data respectively corresponding to the plurality of pixel data may be generated by performing a dithering operation on the image data, dither-irrelevant pixel data that are not changed from the plurality of pixel data by the dithering operation may be detected among the plurality of dithered pixel data, and it may be determined whether the dithered image data represent a still image by using the dither-irrelevant pixel data.

In order to determine whether the dithered image data represent the still image, it may be determined whether the dithered image data represent the still image by comparing the dither-irrelevant pixel data in a first frame and the dither-irrelevant pixel data in a second frame directly after the first frame.

In exemplary embodiments, a ratio of a number of the dither-irrelevant pixel data to a number of the plurality of dithered pixel data may be calculated as a comparison pixel ratio, and the comparison pixel ratio may be compared with a reference pixel ratio.

In order to determine whether the dithered image data represent the still image, it may be determined whether the dithered image data represent the still image by comparing the dither-irrelevant pixel data in a first frame and the dither-irrelevant pixel data in a second frame directly after the first frame when the comparison pixel ratio is greater than or equal to the reference pixel ratio.

Among dither-relevant pixel data other than the dither-irrelevant pixel data in the plurality of dithered pixel data, the dither-relevant pixel data that are not changed in a first frame and a second frame directly after the first frame may be detected based on a dithering pattern of the dithering operation when the comparison pixel ratio is less than the reference pixel ratio, a ratio of a sum of the number of the dither-irrelevant pixel data and a number of the dither-relevant pixel data that are not changed in the first frame and the second frame to the number of the plurality of dithered pixel data may be recalculated as the comparison pixel ratio, and the recalculated comparison pixel ratio may be compared with the reference pixel ratio.

In order to determine whether the dithered image data represent the still image, it may be determined whether the dithered image data represent the still image by using the dither-irrelevant pixel data and the dither-relevant pixel data that are not changed in the first frame and the second frame when the recalculated comparison pixel ratio is greater than or equal to the reference pixel ratio.

The dither-relevant pixel data that are not changed in the first frame and at least one frame subsequent to the second frame may be further detected based on the dithering pattern until the comparison pixel ratio to which a number of the further detected dither-relevant pixel data is applied becomes greater than or equal to the reference pixel ratio when the recalculated comparison pixel ratio is less than the reference pixel ratio. In order to determine whether the dithered image data represent the still image, it may be determined whether the dithered image data represent the still image by using the dither-irrelevant pixel data, the dither-relevant pixel data that are not changed in the first frame and the second frame, and the dither-relevant pixel data that are not changed in the first frame and the at least one frame subsequent to the second frame.

Dither-relevant pixel data that are not changed in a first frame and at least one subsequent frame may be added to comparison pixel data that are used to determine whether the dithered image data represent the still image until the comparison pixel ratio becomes greater than or equal to the reference pixel ratio. In order to determine whether the dithered image data represent the still image, it may be determined whether the dithered image data represent the still image by using the dither-irrelevant pixel data and the dither-relevant pixel data that are not changed in the first frame and the at least one subsequent frame. The subsequent frame may be sequentially selected from a second frame through (2^M+1)-th frame, where M is a bit number corresponding to a dithering cycle of the dither.

A representative value of the dither-irrelevant pixel data in a first frame may be stored. In order to determine whether the dithered image data represent the still image, it may be determined whether the dithered image data represent the still image by comparing the stored representative value and a representative value of the dither-irrelevant pixel data in a second frame directly after the first frame.

Low frequency driving that drives a display panel including the plurality of pixels with a low frame rate lower than a normal frame rate may be performed when the dithered image data represent the still image.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
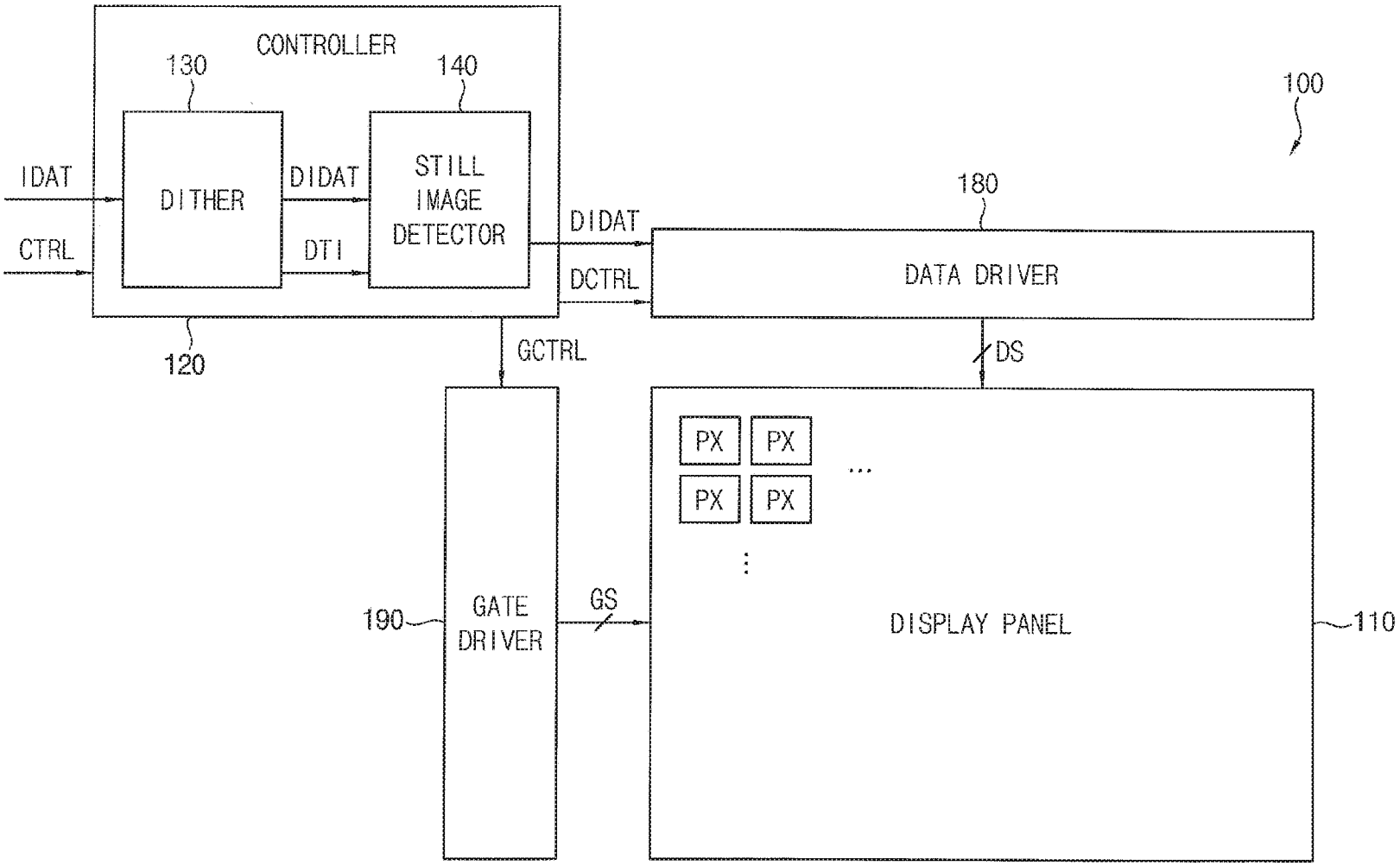
FIG. 1 is a block diagram illustrating a display device according to exemplary embodiments.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, exemplary embodiments of the present inventive concept will be explained in detail with reference to the accompanying drawings.

Figure 2:
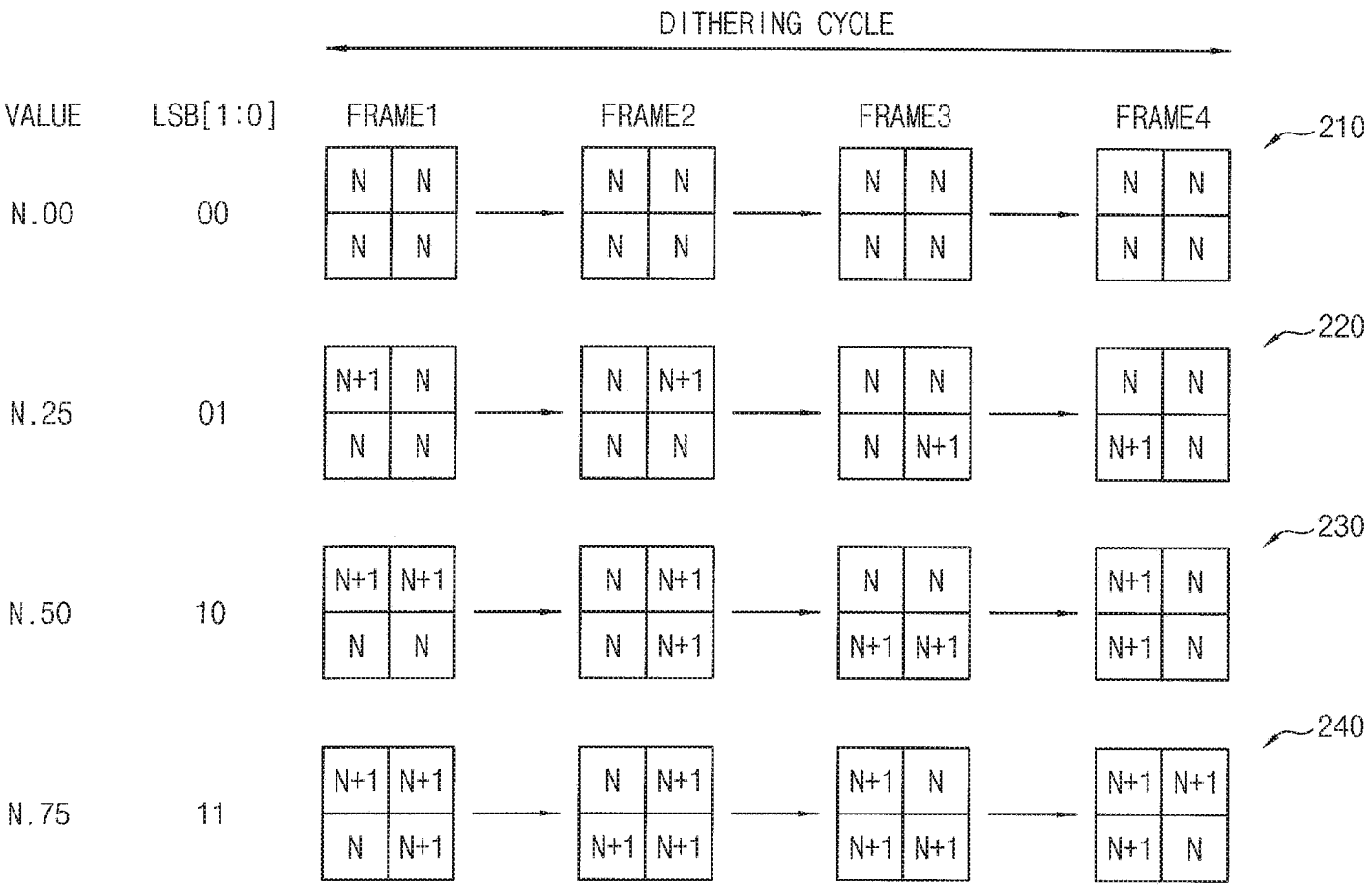
FIG. 2 is a diagram for describing an example of a spatial dithering operation performed by a dither included in a display device of FIG. 1.
Figure 3:
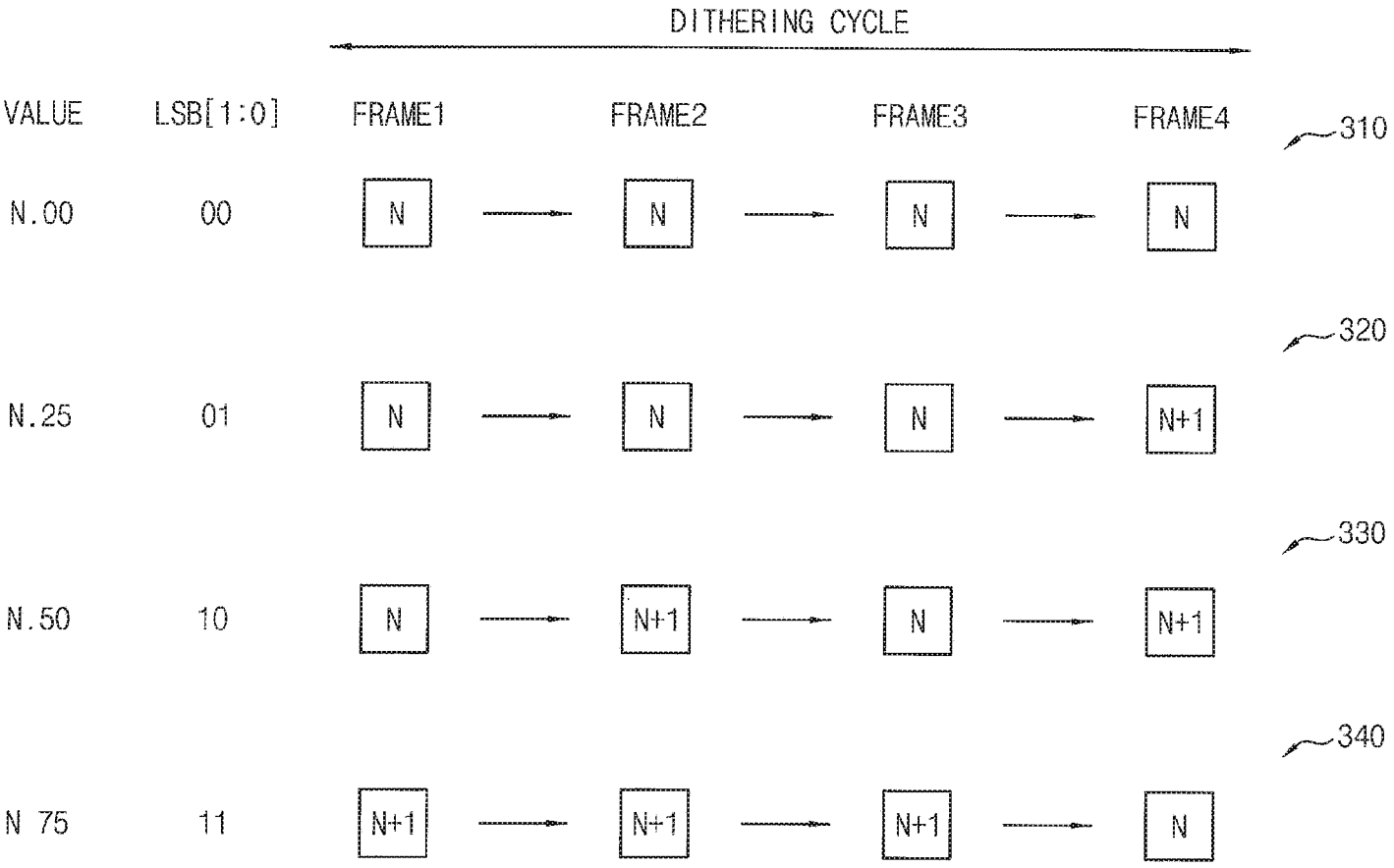
FIG. 3 is a diagram for describing an example of a temporal dithering operation performed by a dither included in a display device of FIG. 1.
Figure 4:
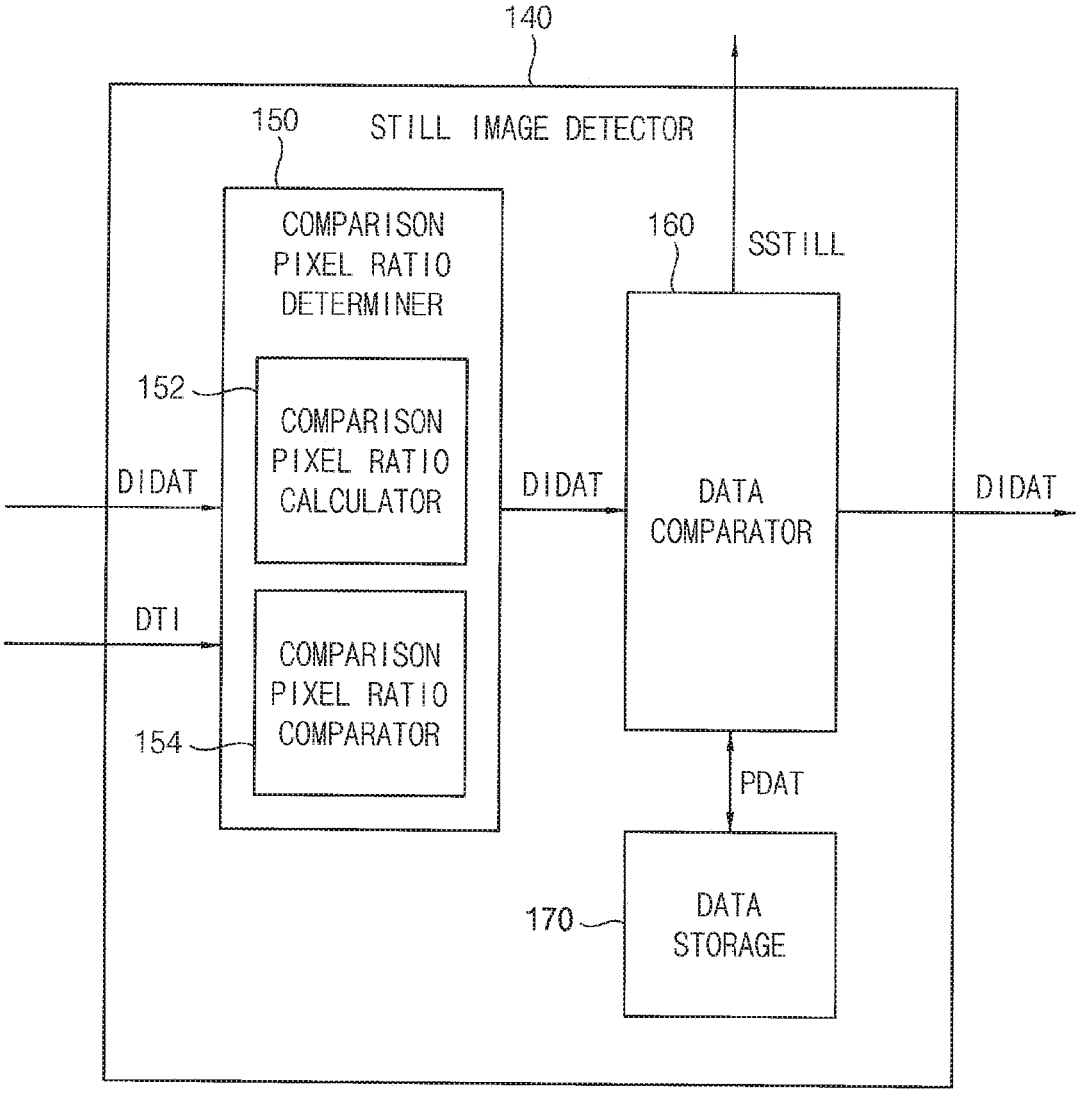
FIG. 4 is a block diagram illustrating a still image detector included in a display device of FIG. 1.

FIG. 1 is a block diagram illustrating a display device according to exemplary embodiments; FIG. 2 is a diagram for describing an example of a spatial dithering operation performed by a dither included in a display device of FIG. 1; FIG. 3 is a diagram for describing an example of a temporal dithering operation performed by a dither included in a display device of FIG. 1; and FIG. 4 is a block diagram illustrating a still image detector included in a display device of FIG. 1.

Referring to FIG. 1, a display device 100 according to exemplary embodiments may include a display panel 110 that includes a plurality of pixels PX and a driver that drives the display panel 110. In some exemplary embodiments, the driver may include a data driver 180 that provides data signals DS to the plurality of pixels PX, a gate driver 190 that provides gate signals GS to the plurality of pixels PX, and a controller 120 that controls an operation of the display device 100.

The display panel 110 may include a plurality of data lines, a plurality of gate lines, and the plurality of pixels PX coupled to the plurality of data lines and the plurality of gate lines. In some exemplary embodiments, each pixel PX may include a switching transistor and a liquid crystal capacitor coupled to the switching transistor, and the display panel 110 may be a liquid crystal display (LCD) panel. In other exemplary embodiments, each pixel PX may include an organic light emitting diode (OLED), at least one capacitor and at least two transistors, and the display panel 110 may be an OLED display panel. However, the display panel 110 is not limited to the LCD panel and the OLED display panel, and may be any suitable display panel.

The controller (e.g., a timing controller; TCON) 120 may receive image data IDAT and a control signal CTRL from an external host processor (e.g., a graphic processing unit (GPU) or a graphic card). In some exemplary embodiments, the control signal CTRL may include, but is not limited to, a vertical synchronization signal, a horizontal synchronization signal, an input data enable signal, a master clock signal, etc. The controller 120 may generate a gate control signal GCTRL and a data control signal DCTRL based on the control signal CTRL. Further, the controller 120 may generate dithered image data DIDAT by performing a dithering operation on the image data IDAT.

The data driver 180 may generate the data signals DS based on the dithered image data DIDAT and the data control signal DCTRL output from the controller 120, and may provide the plurality of pixels PX with the data signals DS corresponding to the dithered image data DIDAT. For example, the data control signal DCTRL may include, but is not limited to, an output data enable signal, a horizontal start signal and a load signal. In some exemplary embodiments, the data driver 180 may be implemented with one or more data integrated circuits (ICs). Further, according to some exemplary embodiments, the data driver 180 may be mounted directly on the display panel 110, or may be coupled to the display panel 110 in a form of a chip-on-film (COF) or a tape carrier package (TCP). In other exemplary embodiments, the data driver 180 may be integrated in a peripheral portion of the display panel 110.

The gate driver 190 may generate the gate signals GS based on the gate control signal GCTRL from the controller 120, and may provide the gate signals GS to the plurality of pixels PX. In some exemplary embodiments, the gate control signal GCTRL may include, but is not limited to, a frame start signal and a gate clock signal. In some exemplary embodiments, the gate driver 190 may be implemented as an amorphous silicon gate (ASG) driver integrated in the peripheral portion of the display panel 110. In other exemplary embodiments, the gate driver 190 may be implemented with one or more gate ICs. Further, according to some exemplary embodiments, the gate driver 190 may be mounted directly on the display panel 110, or may be coupled to the display panel 110 in the form of the COF or the TCP.

The driver of the display device 100 according to exemplary embodiments may include a dither 130 that performs a dithering operation in order to increase grayscale resolution of an image. The dither 130 may perform the dithering operation on the image data DAT including a plurality of pixel data for the plurality of pixels PX to generate dithered image data DIDAT including a plurality of dithered pixel data respectively corresponding to the plurality of pixel data. In some exemplary embodiments, the dither 130 may be included in the controller 120, as illustrated in FIG. 1. In other exemplary embodiments, the dither 130 may be located outside the controller 120, between the controller 120 and the data driver 180, or inside the data driver 180.

In some exemplary embodiments, the dither 130 may perform a spatial dithering operation that represents a grayscale having a bit number greater than a bit number of each pixel data by adjusting pixel data for spatially adjacent pixels PX. FIG. 2 illustrates an example where the grayscale having the bit number (e.g., 10 bits) higher than the bit number (e.g., 8 bits) of each pixel data is represented by the spatial dithering operation.

In a case where a gray level having a value VALUE of 'N.00' is represented at each of adjacent four pixels PX or, in a case where lower bits LSB[1:0] of '00' are represented, all of the dithered pixel data 210 for the adjacent four pixels PX may have a value of 'N'. Further, the dithered pixel data 210 for the adjacent four pixels PX may not be changed within a dithering cycle (or 2^2 frames FRAME1 through FRAME4) corresponding to a dither bit of 2.

In a case where a gray level having a value VALUE of 'N.25' is represented at each of the adjacent four pixels PX, or in a case where lower bits LSB[1:0] of '01' are represented, three of the dithered pixel data 220 for the adjacent four pixels PX may have a value of 'N', and one of the dithered pixel data 220 for the adjacent four pixels PX may have a value of 'N+1'. Further, in order to increase image quality, positions of pixels PX corresponding to the value of 'N' and the value of 'N+1' may be changed per frame FRAME1 through FRAME4 within the dithering cycle.

In a case where a gray level having a value VALUE of 'N.50' is represented at each of the adjacent four pixels PX, or in a case where lower bits LSB[1:0] of '10' are represented, two of the dithered pixel data 230 for the adjacent four pixels PX may have a value of 'N', and two of the dithered pixel data 230 for the adjacent four pixels PX may have a value of 'N+1'. Further, in order to increase image quality, positions of pixels PX corresponding to the value of 'N' and the value of 'N+1' may be changed per frame FRAME1 through FRAME4 within the dithering cycle.

In a case where a gray level having a value VALUE of 'N.75' is represented at each of the adjacent four pixels PX, or in a case where lower bits LSB[1:0] of '11' are represented, one of the dithered pixel data 240 for the adjacent four pixels PX may have a value of 'N', and three of the dithered pixel data 240 for the adjacent four pixels PX may have a value of 'N+1'. Further, in order to increase image quality, positions of pixels PX corresponding to the value of 'N' and the value of 'N+1' may be changed per frame FRAME1 through FRAME4 within the dithering cycle.

In other exemplary embodiments, the dither 130 may perform a temporal dithering operation that represents a grayscale having a bit number greater than a bit number of each pixel data by adjusting pixel data in adjacent frames. FIG. 3 illustrates an example where the grayscale having the bit number (e.g., 10 bits) greater than the bit number (e.g., 8 bits) of each pixel data is represented by the temporal dithering operation.

In a case where a gray level having a value VALUE of 'N.00' is represented at each pixel PX, or in a case where lower bits LSB[1:0] of '00' are represented, all of the dithered pixel data 310 for the pixel PX in the dithering cycle or in 2^2 frames FRAME1 through FRAME4 may have a value of 'N'.

In a case where a gray level having a value VALUE of 'N.25' is represented at each pixel PX, or in a case where lower bits LSB[1:0] of '01' are represented, the dithered pixel data 320 for the pixel PX may have a value of 'N' in three of the four frames FRAME1 through FRAME4 corresponding to the dithering cycle, and may have a value of 'N+1' in one of the four frames FRAME1 through FRAME4.

In a case where a gray level having a value VALUE of 'N.50' is represented at each pixel PX, or in a case where lower bits LSB[1:0] of '10' are represented, the dithered pixel data 330 for the pixel PX may have a value of 'N' in two of the four frames FRAME1 through FRAME4, and may have a value of 'N+1' in the other two of the four frames FRAME1 through FRAME4.

In a case where a gray level having a value VALUE of 'N.75 is represented at each pixel PX, or in a case where lower bits LSB[1:0] of '11' are represented, the dithered pixel data 340 for the pixel PX may have a value of 'N' in one of the four frames FRAME1 through FRAME4, and may have a value of 'N+1' in three of the four frames FRAME1 through FRAME4.

Although an example of the spatial dithering operation is illustrated in FIG. 2 and an example of the temporal dithering operation is illustrated in FIG. 3, the dithering operation of the dither 130 according to exemplary embodiments is not limited to examples of FIGS. 2 and 3.

The display device 100 according to exemplary embodiments may further include a still image detector 140 that detects a still image based on the dithered image data DIDAT generated by the dither 130. In some exemplary embodiments, the still image detector 140 may be included in the controller 120 as illustrated in FIG. 1. In other exemplary embodiments, the still image detector 140 may be located outside the controller 120, between the controller 120 and the data driver 180, or inside the data driver 180.

The still image detector 140 may receive the dithered image data DIDAT from the dither 130, and may detect dither-irrelevant pixel data that are not changed from the plurality of pixel data by the dithering operation among the plurality of dithered pixel data. In examples of FIGS. 2 and 3, the dithered pixel data 210 and 310 representing the lower bits LSB[1:0] of '00' may be detected as the dither-irrelevant pixel data among the plurality of dithered pixel data of the dithered image data DIDAT.

In some exemplary embodiments, the still image detector 140 may detect the dither-irrelevant pixel data among the plurality of dithered pixel data based on dithering information DTI received through the dither 130. In an example, the dithering information DTI may include, with respect to each dithered pixel data, one bit data representing whether the dithering operation is performed. For example, the dithering information DTI may have a value of '1' with respect to the dithered pixel data 210 and 310 representing the lower bits LSB[1:0] of '00', and may have a value of '0' with respect to the dithered pixel data 220, 230, 240, 320, 330, and 340 representing the lower bits LSB[1:0] of '01', '10' or '11'. In this case, the still image detector 140 may detect, as the dither-irrelevant pixel data, the dithered pixel data 210 and 310 corresponding to the dithering information DTI having the value of '1'. In another example, the dithering information DTI may include, with respect to each dithered pixel data, the lower bits LSB[1:0] represented by the dithered pixel data. In this case, for example, the still image detector 140 may detect, as the dither-irrelevant pixel data, the dithered pixel data 210 and 310 corresponding to the dithering information DTI having the value of '00'.

In other exemplary embodiments, the still image detector 140 may detect the dither-irrelevant pixel data among the plurality of dithered pixel data by analyzing the dithered image data DIDAT. In an example of FIG. 2, all of the dithered pixel data 210 for the adjacent four pixels PX may have the value of 'N', and the still image detector 140 may detect, as the dither-irrelevant pixel data, the dithered pixel data 210 all having the value of 'N'.

Further, the still image detector 140 may determine whether the dithered image data DIDAT represent the still image by using the dither-irrelevant pixel data.

In some exemplary embodiments, the still image detector 140 may determine whether the dithered image data DIDAT represent the still image by comparing the dither-irrelevant pixel data in a first frame and the dither-irrelevant pixel data in a second frame directly after the first frame. In an example, the still image detector 140 may determine that the dithered image data DIDAT represent the still image when all of the dither-irrelevant pixel data in the first frame are the same as all of the dither-irrelevant pixel data in the second frame, and may determine that the dithered image data DIDAT represent a moving image when any one of the dither-irrelevant pixel data in the first frame is different from a corresponding one of the dither-irrelevant pixel data in the second frame. In another example, the still image detector 140 may determine that the dithered image data DIDAT represent the still image when a representative value (e.g., a sum or an average) of the dither-irrelevant pixel data in the first frame is the same as a representative value of the dither-irrelevant pixel data in the second frame. Thus, the still image detector 140 may detect the still image only in two frames of the first and second frames although the dithering operation is performed.

In other exemplary embodiments, the still image detector 140 may calculate a ratio of the number of the dither-irrelevant pixel data to the number of the plurality of dithered pixel data, may determine whether the dithered image data DIDAT represent the still image by using the dither-irrelevant pixel data when the calculated ratio is greater than or equal to a reference pixel ratio, and may add dither-relevant pixel data to comparison pixel data that are used to determine whether the dithered image data DIDAT represent the still image when the calculated ratio is less than the reference pixel ratio. In some exemplary embodiments, to perform this operation, as illustrated in FIG. 4, the still image detector 140 may include a comparison pixel ratio determiner 150 and a data comparator 160.

The comparison pixel ratio determiner 150 may divide the plurality of dithered pixel data included in the dithered image data DIDAT into the dither-relevant pixel data (e.g., 220, 230, and 240 in FIG. 2, or 320, 330, and 340 in FIG. 3) that are changed by the dithering operation within the dithering cycle and the dither-irrelevant pixel data (e.g., 210 in FIG. 2 or 310 in FIG. 3) that are not changed by the dithering operation within the dithering cycle. The comparison pixel ratio determiner 150 may detect the dither-irrelevant pixel data among the plurality of dithered pixel data, may calculate, as a comparison pixel ratio, a ratio of the number of the dither-irrelevant pixel data to the number of the plurality of dithered pixel data (e.g., the number of all pixels PX of the display panel 110), and may compare the comparison pixel ratio with the reference pixel ratio.

For example, the comparison pixel ratio determiner 150 may include a comparison pixel ratio calculator 152 and a comparison pixel ratio comparator 154. The comparison pixel ratio calculator 152 may set the dither-irrelevant pixel data as comparison pixel data that are to be compared between the two frames to determine whether the dithered image data DIDAT represent the still image, and may calculate, as the comparison pixel ratio, a ratio of the number of the comparison pixel data to the number of the plurality of dithered pixel data. The comparison pixel ratio comparator 154 may compare the comparison pixel ratio with the reference pixel ratio. In some exemplary embodiments, the reference pixel ratio may be set or changed by the host processor.

In a case where it is determined by the comparison pixel ratio comparator 154 that the comparison pixel ratio is greater than or equal to the reference pixel ratio, the data comparator 160 may determine whether the dithered image data DIDAT represent the still image by comparing the dither-irrelevant pixel data in the first frame and the dither-irrelevant pixel data in the second frame directly after the first frame.

In a case where it is determined by the comparison pixel ratio comparator 154 that the comparison pixel ratio is less than the reference pixel ratio, the comparison pixel ratio calculator 152 may add the dither-relevant pixel data that are not changed in the first frame and at least one subsequent frame to the comparison pixel data that are used to determine whether the dithered image data DIDAT represent the still image until the comparison pixel ratio becomes greater than or equal to the reference pixel ratio. Once the comparison pixel ratio becomes greater than or equal to the reference pixel ratio, the data comparator 160 may determine whether the dithered image data DIDAT represent the still image by using the dither-irrelevant pixel data and the dither-relevant pixel data that are not changed in the first frame and the at least one subsequent frame. Here, in a case where the dither bit of the dither 130 is M, or in a case where the dithering cycle of the dither 130 corresponds to 2ˆM frames, the subsequent frame may be sequentially selected from the second frame through (2¨ M+1)-th frame.

For example, when the comparison pixel ratio is less than the reference pixel ratio, the comparison pixel ratio calculator 152 may detect, among the dither-relevant pixel data other than the dither-irrelevant pixel data in the plurality of dithered pixel data, the dither-relevant pixel data that are not changed in the first frame and the second frame based on a dithering pattern of the dithering operation, and may add the dither-relevant pixel data that are not changed in the first frame and the second frame to the comparison pixel data. Further, the comparison pixel ratio calculator 152 may recalculate, as the comparison pixel ratio, a ratio of the number of the comparison pixel data to the number of the plurality of dithered pixel data, or a ratio of a sum of the number of the dither-irrelevant pixel data and the number of the dither-relevant pixel data that are not changed in the first frame and the second frame to the number of the plurality of dithered pixel data. The comparison pixel ratio comparator 154 may compare the recalculated comparison pixel ratio with the reference pixel ratio. When the recalculated comparison pixel ratio is greater than or equal to the reference pixel ratio, the data comparator 160 may determine whether the dithered image data DIDAT represent the still image by using the dither-irrelevant pixel data and the dither-relevant pixel data that are not changed in the first frame and the second frame.

When the recalculated comparison pixel ratio is less than the reference pixel ratio, the comparison pixel ratio calculator 152 may further detect the dither-relevant pixel data that are not changed in the first frame and a third frame subsequent to the second frame based on the dithering pattern, and may further add the dither-relevant pixel data that are not changed in the first and third frames to the comparison pixel data. Further, the comparison pixel ratio calculator 152 may recalculate, as the comparison pixel ratio, a ratio of the number of the comparison pixel data to the number of the plurality of dithered pixel data, or a ratio of a sum of the number of the dither-irrelevant pixel data, the number of the dither-relevant pixel data that are not changed in the first and second frames and the number of the dither-relevant pixel data that are not changed in the first and third frames to the number of the plurality of dithered pixel data. The data comparator 160 may determine whether the dithered image data DIDAT represent the still image by using the dither-irrelevant pixel data, the dither-relevant pixel data that are not changed in the first and second frames, and the dither-relevant pixel data that are not changed in the first and third frames. Adding the dither-relevant pixel data that are not changed in the first frame and a subsequent frame to the comparison pixel data may be repeated until the comparison pixel ratio becomes greater than or equal to the reference pixel ratio. Further, even if the reference pixel ratio has a maximum value, or about 100%, when the subsequent frame is selected up to the (2¨M+1)-th frame, all the dithered pixel data, or all the dither-irrelevant pixel data and all the dither-relevant pixel data are selected as the comparison pixel data, and thus the still image detection operation by the still image detector 140 may be completed, at most, within (2ˆM+1) frames.

In some exemplary embodiments, the data comparator 160 may compare respective ones of the comparison pixel data (e.g., the dither-irrelevant pixel data, or the dither-irrelevant pixel data and at least a portion of the dither-relevant pixel data) in at least two frames, and may determine that the dithered image data DIDAT represent the moving image when any one pair of the comparison pixel data are different from each other. To compare the comparison pixel data in the two frames by the data comparator 160, in some exemplary embodiments, the still image detector 140 may further include a data storage 170 that stores, as data PDAT of a previous frame (e.g., the first frame), the comparison pixel data in the previous frame.

In other exemplary embodiments, the data comparator 160 may compare representative values of the comparison pixel data in at least two frames, and may determine that the dithered image data DIDAT represent the moving image when the representative values are different from each other. For example, the representative value may be, but not limited to, a sum of all the comparison pixel data in each frame. In this case, the data storage 170 may store, as the data PDAT of the previous frame, the representative value of the comparison pixel data in the previous frame. For example, in the second frame, the data comparator 170 may calculate the representative value of the dither-irrelevant pixel data included in the dithered image data DIDAT received from the dither 130, and may determine whether the dithered image data DIDAT represent the still image by comparing the representative value of the first frame stored in the data storage 170 and the calculated representative value.

When it is determined that the dithered image data DIDAT represent the still image, the still image detector 140 may output a still image detection signal SSTILL representing that the still image is detected. The controller 120 may perform low frequency driving that drives the display panel 110 with a low frame rate lower than a normal frame rate in response to the still image detection signal SSTILL representing that the still image is detected. For example, when the still image is detected, the controller 120 may control the data driver 180 and the gate driver 190 to drive the display panel 110 with the low frame rate (e.g., about 1 Hz) lower than the normal frame rate (e.g., about 60 Hz). Accordingly, when the still image is displayed, power consumption of the display device 100 may be reduced.

As described above, the display device 100 according to exemplary embodiments may detect the dither-irrelevant pixel data that are not changed from the plurality of pixel data by the dithering operation among the plurality of dithered pixel data, and may determine whether the dithered image data DIDAT represent the still image by using the dither-irrelevant pixel data, thereby rapidly detecting the still image even if the dithering operation is performed.

Figure 5:
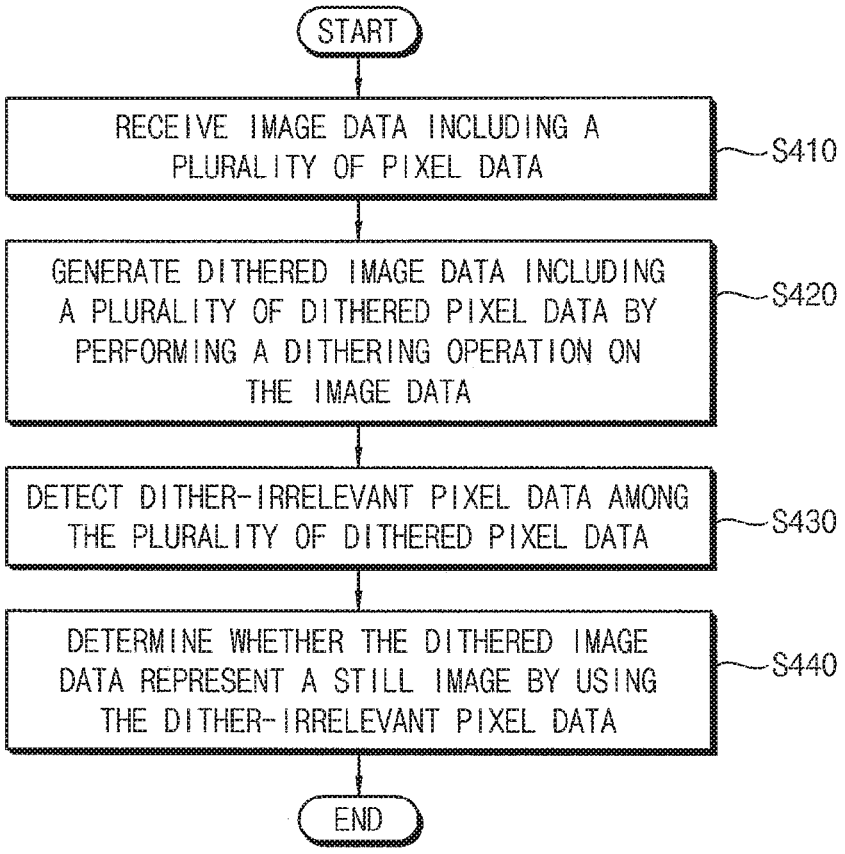
FIG. 5 is a flowchart illustrating a method of operating a display device according to exemplary embodiments.
Figure 6:
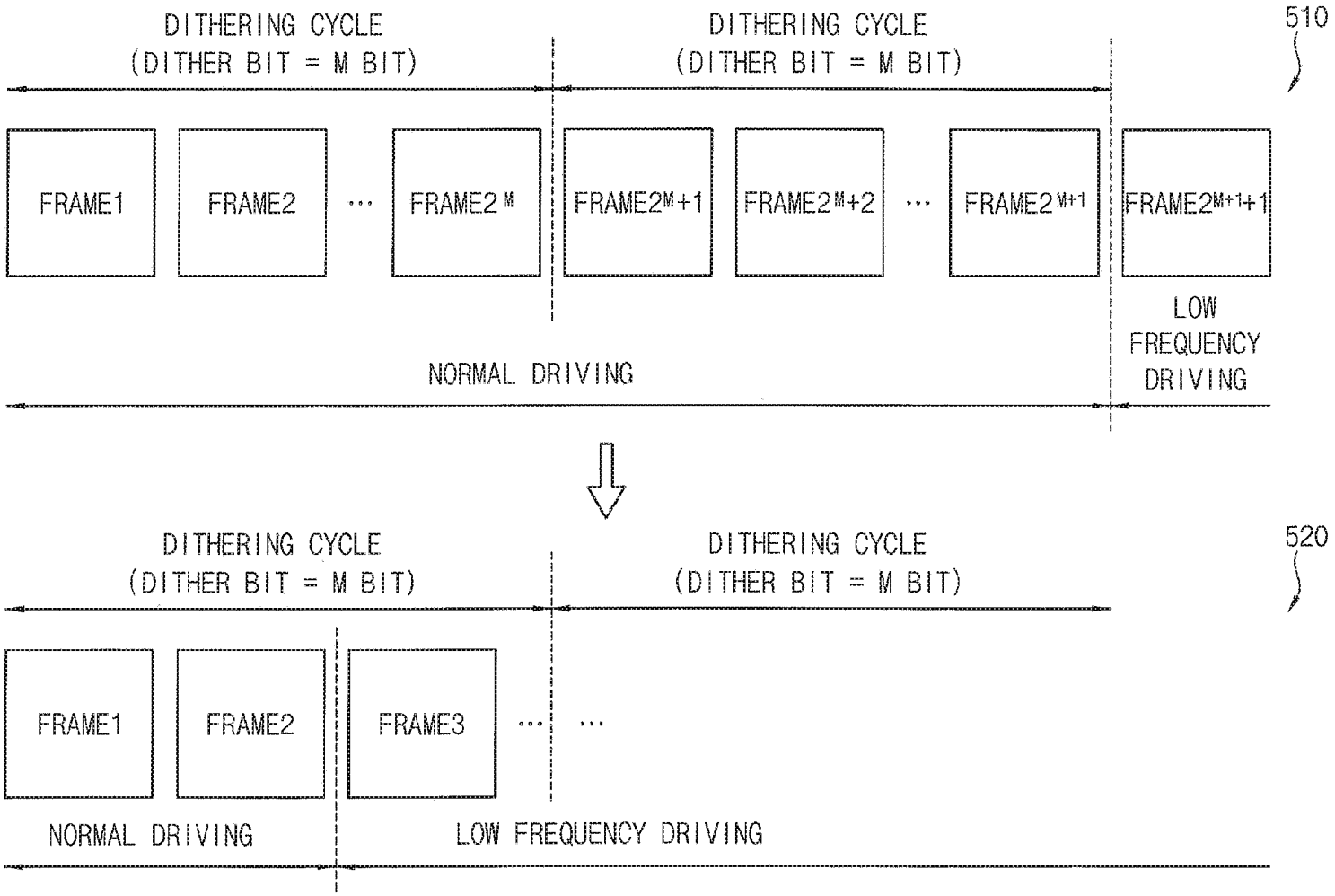
FIG. 6 is a diagram for describing a still image detection time period required in a conventional still image detection method and a still image detection time period required in a still image detection method according to exemplary embodiments.

FIG. 5 is a flowchart illustrating a method of operating a display device according to exemplary embodiments, and FIG. 6 is a diagram for describing a still image detection time period required in a conventional still image detection method and a still image detection time period required in a still image detection method according to an exemplary embodiment of the present invention.

Referring to FIGS. 1 and 5, in a method of operating a display device 100 including a plurality of pixels PX, the display device 100 may receive image data IDAT including a plurality of pixel data for the plurality of pixels PX (S410). A dither 130 of the display device 100 may generate dithered image data DIDAT including a plurality of dithered pixel data respectively corresponding to the plurality of pixel data by performing a dithering operation (e.g., a spatial dithering operation and/or a temporal dithering operation) on the image data DAT (S420).

A still image detector 140 may detect dither-irrelevant pixel data that are not changed from the plurality of pixel data by the dithering operation among the plurality of dithered pixel data of the dithered image data DIDAT (S430), and may determine whether the dithered image data DIDAT represent a still image by using the dither-irrelevant pixel data (S440). When it is determined that the dithered image data DIDAT represent the still image, the display device 100 may perform low frequency driving that drives a display panel 110 including the plurality of pixels PX with a low frame rate lower than a normal frame rate.

In a display device to which a dithering technique is applied, even if the still image is displayed, dithered image data may be changed per frame within a dithering cycle. Accordingly, as illustrated in 510 of FIG. 6, a conventional display device to which the dithering technique is applied may perform a still image detection operation for two dithering cycles, or for 2^(M+1) frames in case of the dithering operation with a dither bit of M. For example, the conventional display device may detect the still image by comparing the dithered image data in a first frame FRAME1 and the dithered image data in a (2^M+1)-th frame FRAME2$^{M}$+1, by comparing the dithered image data in a second frame FRAME2 and the dithered image data in a (2^M+2)-th frame FRAME2$^{M}$+2, . . . , and by comparing the dithered image data in a (2^M)-th frame FRAME2$^{M}$ and the dithered image data in a (2^(M+1))-th frame FRAME2$^{M+1}$. Accordingly, the conventional display device may perform the low frequency driving 2^(M+1) frames after a time point at which the still image is displayed.

However, in the method of operating the display device 100 according to exemplary embodiments, the dither-irrelevant pixel data that are not changed from the plurality of pixel data by the dithering operation may be detected among the plurality of dithered pixel data, and whether the dithered image data DIDAT represent the still image may be determined by comparing the dither-irrelevant pixel data in the first frame FRAME1 and the dither-irrelevant pixel data in the second frame FRAME2. Accordingly, in the method of operating the display device 100 according to exemplary embodiments, as illustrated in 520 of FIG. 6, the low frequency driving may be performed two frames after the time point at which the still image is displayed. That is, in the method of operating the display device 100 according to exemplary embodiments, the still image may be rapidly detected even if the dithering operation is performed, and the low frequency driving may be rapidly performed, thereby reducing the power consumption of the display device 100.

Figure 7:
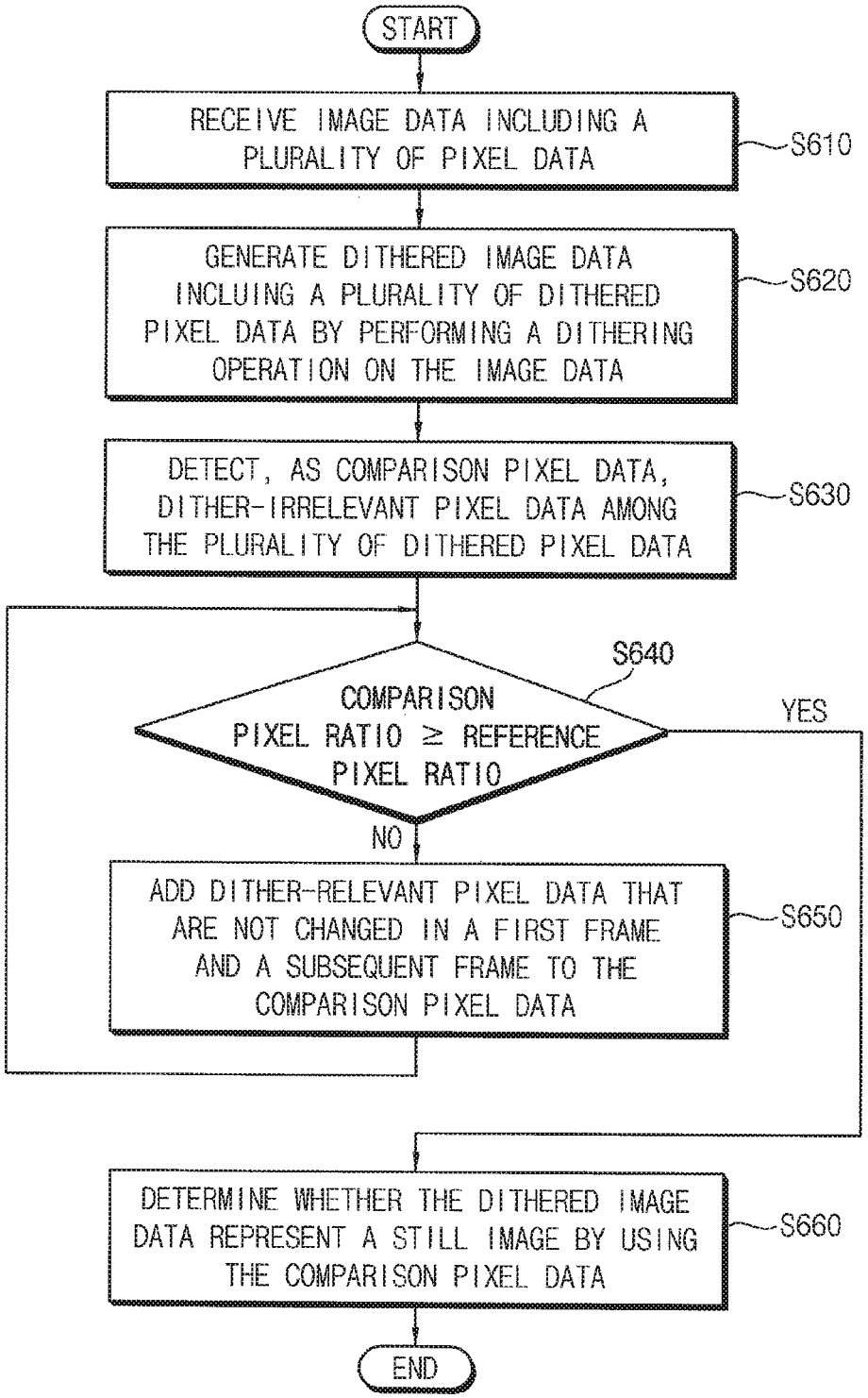
FIG. 7 is a flowchart illustrating a method of operating a display device according to exemplary embodiments.
Figure 8:
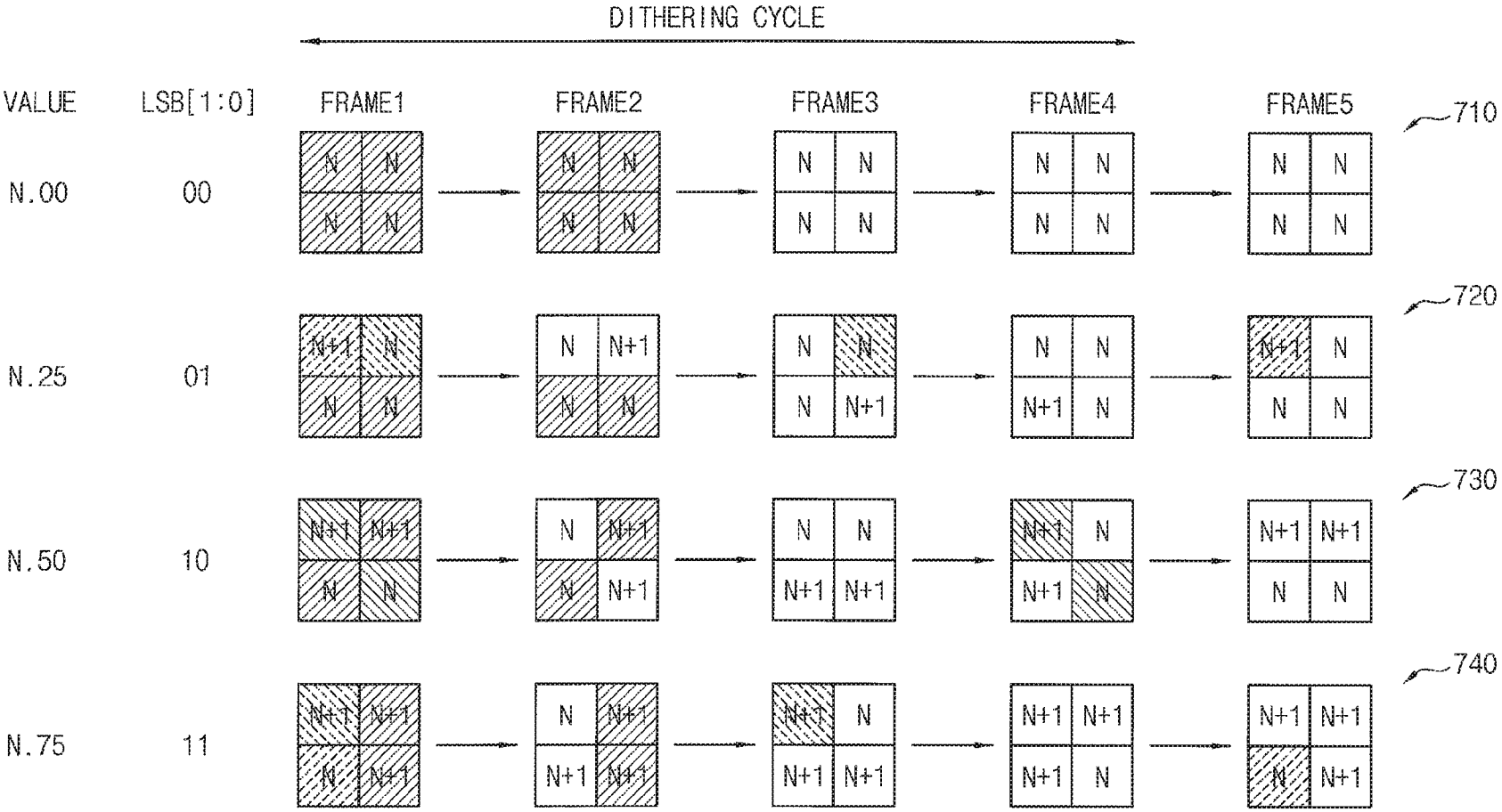
FIG. 8 is a diagram for describing an example where dither-relevant pixel data that are not changed in a first frame and a subsequent frame are added to comparison pixel data when a spatial dithering operation is performed.
Figure 9:
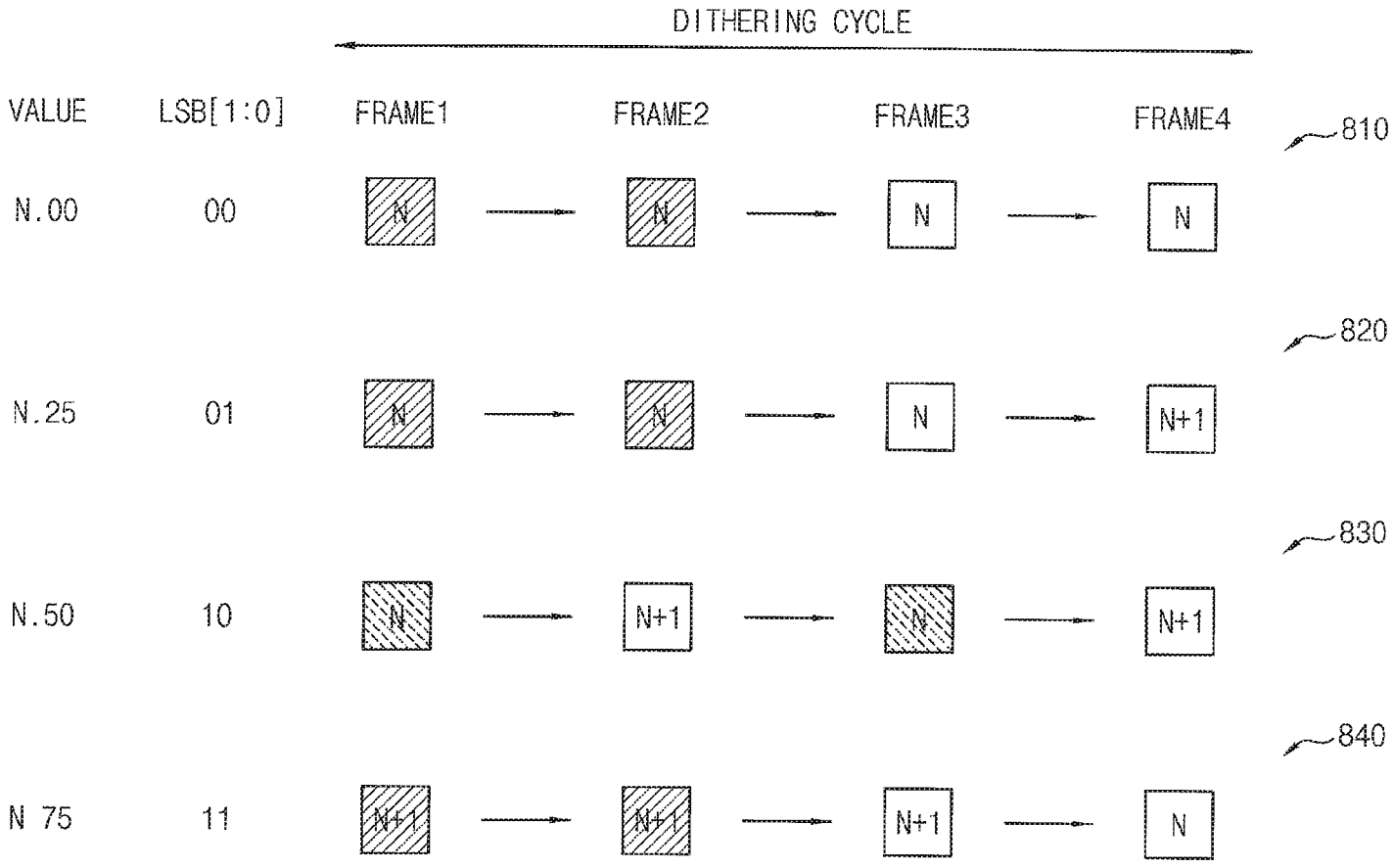
FIG. 9 is a diagram for describing an example where dither-relevant pixel data that are not changed in a first frame and a subsequent frame are added to comparison pixel data when a temporal dithering operation is performed.

FIG. 7 is a flowchart illustrating a method of operating a display device according to exemplary embodiments; FIG. 8 is a diagram for describing an example where dither-relevant pixel data that are not changed in a first frame and a subsequent frame are added to comparison pixel data when a spatial dithering operation is performed; and FIG. 9 is a diagram for describing an example where dither-relevant pixel data that are not changed in a first frame and a subsequent frame are added to comparison pixel data when a temporal dithering operation is performed.

Referring to FIGS. 1 and 7, in a method of operating a display device 100 including a plurality of pixels PX, the display device 100 may receive image data IDAT including a plurality of pixel data for the plurality of pixels PX (S610). A dither 130 of the display device 100 may generate dithered image data DIDAT including a plurality of dithered pixel data respectively corresponding to the plurality of pixel data by performing a dithering operation (e.g., a spatial dithering operation and/or a temporal dithering operation) on the image data IDAT (S620).

A still image detector 140 may detect, as comparison pixel data that are to be compared in two frames to detect a still image, dither-irrelevant pixel data that are not changed from the plurality of pixel data by the dithering operation among the plurality of dithered pixel data (S630). For example, the still image detector 140 may detect, as the dither-irrelevant pixel data, dithered pixel data 710 representing lower bits LSB[1:0] of '00' in FIG. 8 or dithered pixel data 810 representing lower bits LSB[1:0] of '00' in FIG. 9.

The still image detector 140 may calculate, as a comparison pixel ratio, a ratio of the number of the comparison pixel data to the number of the plurality of dithered pixel data, or a ratio of the dither-irrelevant pixel data to the number of the plurality of dithered pixel data, and may compare the comparison pixel ratio with a reference pixel ratio (S640). When the comparison pixel ratio is greater than or equal to the reference pixel ratio (S640: YES), the still image detector 140 may determine whether the dithered image data DIDAT represent the still image by comparing (a representative value of) the dither-irrelevant pixel data in a first frame and (a representative value of) the dither-irrelevant pixel data in a second frame directly after the first frame (S660).

When the comparison pixel ratio is less than the reference pixel ratio (S640: NO), until the comparison pixel ratio becomes greater than or equal to the reference pixel ratio, the still image detector 140 may add dither-relevant pixel data that are not changed in the first frame and at least one subsequent frame to the comparison pixel data that are used to determine whether the dithered image data DIDAT represent the still image (S650). Here, in a case where the dither operation is performed with a dither bit of M, the subsequent frame may be sequentially selected from the second frame through (2^M+1)-th frame until the comparison pixel ratio becomes greater than or equal to the reference pixel ratio. Once the comparison pixel ratio becomes greater than or equal to the reference pixel ratio (S640: YES), the still image detector 140 may determine whether the dithered image data DIDAT represent the still image by using the comparison pixel data, or by using the dither-irrelevant pixel data and the dither-relevant pixel data that are not changed in the first frame and the at least one subsequent frame (S660).

For example, when the comparison pixel ratio to which only the number of the dither-irrelevant pixel data is applied is less than the reference pixel ratio (S640: NO), the still image detector 140 may detect, among the dither-relevant pixel data other than the dither-irrelevant pixel data in the plurality of dithered pixel data, the dither-relevant pixel data that are not changed in the first and second frames based on a dithering pattern of the dithering operation, and may add the dither-relevant pixel data that are not changed in the first and second frames to the comparison pixel data including only the dither-irrelevant pixel data (S650).

In an example of FIG. 8, the still image detector 140 may add, among four dither-relevant pixel data 720 representing lower bits LSB[1:0] of '01', two dither-relevant pixel data for bottom-left and bottom-right pixels PX that are not changed in the first frame FRAME1 and the second frame FRAME2 to the comparison pixel data. Further, the still image detector 140 may add, among four dither-relevant pixel data 730 representing lower bits LSB[1:0] of '10', two dither-relevant pixel data for bottom-left and top-right pixels PX that are not changed in the first frame FRAME1 and the second frame FRAME2 to the comparison pixel data. Further, the still image detector 140 may add, among four dither-relevant pixel data 740 representing lower bits LSB[1:0] of '11', two dither-relevant pixel data for top-right and bottom-right pixels PX that are not changed in the first frame FRAME1 and the second frame FRAME2 to the comparison pixel data.

In another example of FIG. 9, the still image detector 140 may add dither-relevant pixel data 820 and 840 that are not changed in the first frame FRAME1 and the second frame FRAME2 to the comparison pixel data. That is, the still image detector 140 may add the dither-relevant pixel data 820 representing lower bits LSB[1:0] of '01' and the dither-relevant pixel data 740 representing lower bits LSB[1:0] of '11' to the comparison pixel data. Although FIGS. 8 and 9 illustrate examples of the plurality of dithered pixel data, the dither-relevant pixel data that are not changed in the first frame FRAME1 and the subsequent frame may be different from the examples of FIGS. 8 and 9 according to a dithering pattern of the dithering operation performed by the dither 130.

The still image detector 140 may recalculate, as the comparison pixel ratio, a ratio of the number of the comparison pixel data (or a sum of the number of the dither-irrelevant pixel data and the number of the dither-relevant pixel data that are not changed in the first and second frames) to the number of the plurality of dithered pixel data, and may compare the recalculated comparison pixel ratio with the reference pixel ratio (S640). When the recalculated comparison pixel ratio is greater than or equal to the reference pixel ratio (S640: YES), the still image detector 140 may determine whether the dithered image data represent the still image by using the comparison pixel data, or by using the dither-irrelevant pixel data and the dither-relevant pixel data that are not changed in the first and second frames (S660).

When the recalculated comparison pixel ratio, or the comparison pixel ratio to which the number of the dither-irrelevant pixel data and the number of the dither-relevant pixel data that are not changed in the first and second frames are applied is less than the reference pixel ratio (S640: NO), the still image detector 140 may further detect the dither-relevant pixel data that are not changed in the first frame and at least one frame subsequent to the second frame based on the dithering pattern, and may add the further detected dither-relevant pixel data to the comparison pixel data (S650). The subsequent frame may be sequentially selected in an order of a third frame, a fourth frame, a fifth frame, etc., and the selection of the subsequent frame may be performed up to a (2^M+1)-th frame in a case where the dithering operation is performed with a dither bit of M. For example, as illustrated in FIG. 8, as the dither-relevant pixel data that are not changed in the first frame FRAME1 and the third frame FRAME3, the dither-relevant pixel data for a top-right pixel PX among four dither-relevant pixel data 720 representing lower bits LSB[1:0] of '01', and the dither-relevant pixel data for a top-left pixel PX among four dither-relevant pixel data 740 representing lower bits LSB[1:0] of '11' may be detected. Further, as the dither-relevant pixel data that are not changed in the first frame FRAME1 and the fourth frame FRAME4, the dither-relevant pixel data for top-left and bottom-right pixels PX among four dither-relevant pixel data 730 representing lower bits LSB[1:0] of '10' may be detected. Further, as the dither-relevant pixel data that are not changed in the first frame FRAME1 and the fifth frame FRAME5, the dither-relevant pixel data for a top-left pixel PX among four dither-relevant pixel data 720 representing lower bits LSB[1:0] of '01', and the dither-relevant pixel data for a bottom-left pixel PX among four dither-relevant pixel data 740 representing lower bits LSB[1:0] of '11' may be detected. In an example of FIG. 8, once the dither-relevant pixel data that are not changed in the first frame FRAME1 and the fifth frame FRAME5 are added to the comparison pixel data, the number of the comparison pixel data may become the same as the number of the plurality of dithered pixel data, and thus the further addition of the dither-relevant pixel data may be unnecessary. In another example, as illustrated in FIG. 9, as the dither-relevant pixel data that are not changed in the first frame FRAME1 and the third frame FRAME3, dither-relevant pixel data 830 representing lower bits LSB[1:0] of '10' may be added to the comparison pixel data.

The still image detector 140 may determine whether the dithered image data DIDAT represent the still image by using comparison pixel data, or by using the dither-irrelevant pixel data, the dither-relevant pixel data that are not changed in the first frame and the second frame, and the dither-relevant pixel data that are not changed in the first frame and the at least one subsequent frame (S660).

When it is determined that the dithered image data DIDAT represent the still image, the display device 100 may perform low frequency driving that drives a display panel 110 including the plurality of pixels PX with a low frame rate lower than a normal frame rate. Accordingly, when the still image is displayed, power consumption of the display device 100 may be reduced.

As described above, in the method of operating the display device 100 according to exemplary embodiments, the dither-relevant pixel data may be added to the comparison pixel data such that the comparison pixel ratio becomes greater than or equal to the reference pixel ratio, and may determine whether the dithered image data DIDAT represent the still image by using the comparison pixel data including the dither-irrelevant pixel data and the dither-relevant pixel data. Accordingly, the still image may be rapidly detected, and the power consumption of the display device 100 may be reduced.

Figure 10:
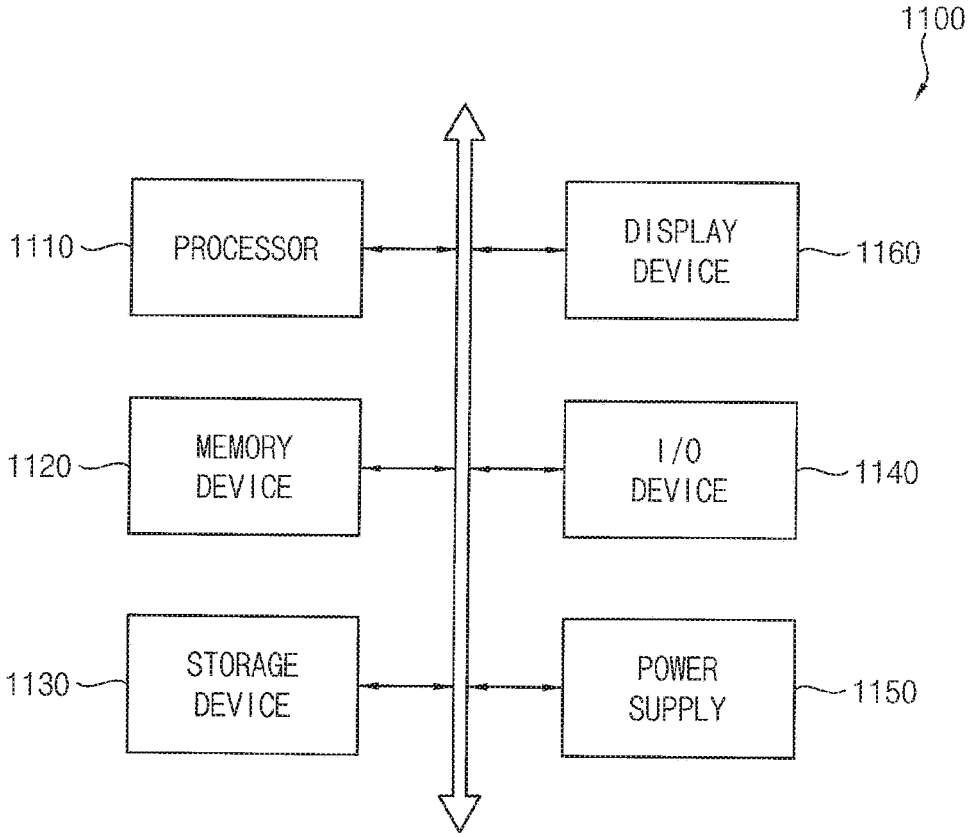
FIG. 10 is an electronic device including a display device according to exemplary embodiments.

FIG. 10 is an electronic device including a display device according to exemplary embodiments.

Referring to FIG. 10, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some exemplary embodiments, the processor 1110 may be further coupled to an extended bus, such as a peripheral component interconnection (PCI) bus.

The memory device 1120 may store data for operations of the electronic device 1100. For example, the memory device 1120 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may detect dither-irrelevant pixel data that are not changed by a dithering operation among a plurality of dithered pixel data, and may determine whether dithered image data represent a still image by using the dither-irrelevant pixel data. Accordingly, the still image may be rapidly detected even if the dithering operation is performed, and power consumption of the display device 1160 may be reduced.

The inventive concepts may be applied to any display device 1160, and any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

As described above, a display device and a method of operating the display device according to exemplary embodiments may detect dither-irrelevant pixel data that are not changed from a plurality of pixel data by a dithering operation among a plurality of dithered pixel data, and may determine whether dithered image data represent a still image by using the dither-irrelevant pixel data, thereby rapidly detecting the still image even if the dithering operation is performed.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel including a plurality of pixels; and a driver configured to drive the display panel, the driver comprising:

a dither configured to perform a dithering operation on image data, including a plurality of pixel data for the plurality of pixels, to generate dithered image data including a plurality of dithered pixel data respectively corresponding to the plurality of pixel data; and a still image detector configured to receive the dithered image data, to divide the plurality of dithered pixel data into dither-relevant pixel data that are changed from the plurality of pixel data by the dithering operation and dither-irrelevant pixel data that are not changed from the plurality of pixel data by the dithering operation, and to determine whether the dithered image data represent a still image by comparing the dither-irrelevant pixel data in a first frame and the dither-irrelevant pixel data in a second frame directly after the first frame, wherein the driver is configured to perform low frequency driving of the display panel with a low frame rate lower than a normal frame rate when the dithered image data represent the still image.

2. The display device of claim 1, wherein the still image detector includes a comparison pixel ratio determiner configured to:

detect the dither-irrelevant pixel data among the plurality of dithered pixel data;

calculate, as a comparison pixel ratio, a ratio of a number of the dither-irrelevant pixel data to a number of the plurality of dithered pixel data; and compare the comparison pixel ratio with a reference pixel ratio.

3. The display device of claim 2, wherein the still image detector further includes:

a data comparator configured to determine whether the dithered image data represent the still image by comparing the dither-irrelevant pixel data in the first frame and the dither-irrelevant pixel data in the second frame when the comparison pixel ratio is greater than or equal to the reference pixel ratio.

4. The display device of claim 2, wherein, when the comparison pixel ratio is less than the reference pixel ratio, the comparison pixel ratio determiner is configured to:

detect, among dither-relevant pixel data other than the dither-irrelevant pixel data in the plurality of dithered pixel data, the dither-relevant pixel data that are not changed in the first frame and the second frame based on a dithering pattern of the dithering operation;

recalculate, as the comparison pixel ratio, a ratio of a sum of the number of the dither-irrelevant pixel data and a number of the dither-relevant pixel data that are not changed in the first frame and the second frame to the number of the plurality of dithered pixel data; and compare the recalculated comparison pixel ratio with the reference pixel ratio.

5. The display device of claim 4, wherein the still image detector further includes a data comparator configured to determine whether the dithered image data represent the still image by using the dither-irrelevant pixel data and the dither-relevant pixel data that are not changed in the first frame and the second frame when the recalculated comparison pixel ratio is greater than or equal to the reference pixel ratio.

6. The display device of claim 4, wherein:

when the recalculated comparison pixel ratio is less than the reference pixel ratio, the comparison pixel ratio determiner is configured to further detect the dither-relevant pixel data that are not changed in the first frame and at least one frame subsequent to the second frame based on the dithering pattern until the comparison pixel ratio to which a number of the further detected dither-relevant pixel data is applied becomes greater than or equal to the reference pixel ratio; and the still image detector further includes a data comparator configured to determine whether the dithered image data represent the still image by using the dither-irrelevant pixel data, the dither-relevant pixel data that are not changed in the first frame and the second frame, and the dither-relevant pixel data that are not changed in the first frame and the at least one frame subsequent to the second frame.

7. The display device of claim 2, wherein:

the comparison pixel ratio determiner is configured to add dither-relevant pixel data that are not changed in the first frame and at least one subsequent frame to comparison pixel data that are used to determine whether the dithered image data represent the still image until the comparison pixel ratio becomes greater than or equal to the reference pixel ratio;

the still image detector further includes a data comparator configured to determine whether the dithered image data represent the still image by using the dither-irrelevant pixel data and the dither-relevant pixel data that are not changed in the first frame and the at least one subsequent frame; and wherein the subsequent frame is sequentially selected from the second frame through (2^M+1)-th frame, where M is a bit number corresponding to a dithering cycle of the dither.

8. The display device of claim 2, wherein the still image detector further includes:

a data storage configured to store a representative value of the dither-irrelevant pixel data in the first frame; and a data comparator configured to determine whether the dithered image data represent the still image by comparing the representative value stored in the data storage and a representative value of the dither-irrelevant pixel data in the second frame.

9. A method of operating a display device including a plurality of pixels, the method comprising:

receiving image data including a plurality of pixel data for the plurality of pixels;

generating dithered image data including a plurality of dithered pixel data respectively corresponding to the plurality of pixel data by performing a dithering operation on the image data;

dividing the plurality of dithered pixel data into dither-relevant pixel data that are changed from the plurality of pixel data by the dithering operation and dither-irrelevant pixel data that are not changed from the plurality of pixel data by the dithering operation;

determining whether the dithered image data represent a still image by comparing the dither-irrelevant pixel data in a first frame and the dither-irrelevant pixel data in a second frame directly after the first frame; and performing low frequency driving that drives a display panel including the plurality of pixels with a low frame rate lower than a normal frame rate when the dithered image data represent the still image.

10. The method of claim 9, further comprising:

calculating, as a comparison pixel ratio, a ratio of a number of the dither-irrelevant pixel data to a number of the plurality of dithered pixel data; and comparing the comparison pixel ratio with a reference pixel ratio.

11. The method of claim 10, wherein determining whether the dithered image data represent the still image includes determining whether the dithered image data represent the still image by comparing the dither-irrelevant pixel data in the first frame and the dither-irrelevant pixel data in the second frame when the comparison pixel ratio is greater than or equal to the reference pixel ratio.

12. The method of claim 10, further comprising:

detecting, among dither-relevant pixel data other than the dither-irrelevant pixel data in the plurality of dithered pixel data, the dither-relevant pixel data that are not changed in the first frame and the second frame based on a dithering pattern of the dithering operation when the comparison pixel ratio is less than the reference pixel ratio;

recalculating, as the comparison pixel ratio, a ratio of a sum of the number of the dither-irrelevant pixel data and a number of the dither-relevant pixel data that are not changed in the first frame and the second frame to the number of the plurality of dithered pixel data; and comparing the recalculated comparison pixel ratio with the reference pixel ratio.

13. The method of claim 12, wherein determining whether the dithered image data represent the still image includes determining whether the dithered image data represent the still image by using the dither-irrelevant pixel data and the dither-relevant pixel data that are not changed in the first frame and the second frame when the recalculated comparison pixel ratio is greater than or equal to the reference pixel ratio.

14. The method of claim 12, further comprising:

further detecting the dither-relevant pixel data that are not changed in the first frame and at least one frame subsequent to the second frame based on the dithering pattern until the comparison pixel ratio to which a number of the further detected dither-relevant pixel data is applied becomes greater than or equal to the reference pixel ratio when the recalculated comparison pixel ratio is less than the reference pixel ratio, wherein determining whether the dithered image data represent the still image includes:

determining whether the dithered image data represent the still image by using the dither-irrelevant pixel data, the dither-relevant pixel data that are not changed in the first frame and the second frame, and the dither-relevant pixel data that are not changed in the first frame and the at least one frame subsequent to the second frame.

15. The method of claim 10, further comprising adding dither-relevant pixel data that are not changed in the first frame and at least one subsequent frame to comparison pixel data that are used to determine whether the dithered image data represent the still image until the comparison pixel ratio becomes greater than or equal to the reference pixel ratio, wherein:

determining whether the dithered image data represent the still image includes using the dither-irrelevant pixel data and the dither-relevant pixel data that are not changed in the first frame and the at least one subsequent frame; and the subsequent frame is sequentially selected from the second frame through (2^M+1)-th frame, where M is a bit number corresponding to a dithering cycle of the dither.

16. The method of claim 9, further comprising storing a representative value of the dither-irrelevant pixel data in the first frame, wherein determining whether the dithered image data represent the still image includes comparing the stored representative value and a representative value of the dither-irrelevant pixel data in the second frame.

* * * * *